US006306231B1

(12) United States Patent
Sakamoto et al.

(10) Patent No.: US 6,306,231 B1
(45) Date of Patent: Oct. 23, 2001

(54) METHOD OF PRODUCING LIGHT METAL ALLOY MATERIAL FOR PLASTIC WORKING AND PLASTIC-WORKED PRODUCT

(75) Inventors: Kazuo Sakamoto; Kyoso Ishida; Yukio Yamamoto, all of Hiroshima; Makoto Fujita, Higashihiroshima, all of (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/162,229

(22) Filed: Sep. 29, 1998

(30) Foreign Application Priority Data

Sep. 29, 1997 (JP) ..... 9-263903

(51) Int. Cl.[7] ..... B22D 17/00

(52) U.S. Cl. ..... 148/666; 148/667; 164/76.1; 164/113; 164/900

(58) Field of Search ..... 148/666, 667, 148/550; 164/76.1, 113, 900

(56) References Cited

U.S. PATENT DOCUMENTS 5,693,158 * 12/1997 Yamamoto et al. ..... 148/557

FOREIGN PATENT DOCUMENTS

| | | | |
|---|---|---|---|
| 0 575 796 | | 12/1993 | (EP) . |
| 0 701 002 | | 3/1996 | (EP) . |
| 755738 | * | 1/1997 | (EP) . |
| 06228720 | | 8/1994 | (JP) . |
| 07188826 | | 7/1995 | (JP) . |
| 07224344 | | 8/1995 | (JP) . |

* cited by examiner

*Primary Examiner*—Sikyin Ip
(74) *Attorney, Agent, or Firm*—Nixon Peabody LLP; Donald R. Studebaker

(57) ABSTRACT

A light metal alloy material has excellent plastic workability. The method of producing the light metal alloy material comprises a light metal as a matrix, which is injection-molded at a solid phase proportion of not more than 20%. The injection molded material has a limiting upsetting rate of not more than 70% and excellent moldability. This injection molded material can be molded into a final molded article by means of single-step forging.

10 Claims, 9 Drawing Sheets

Injection molding of rough material

Die opening, Removal of material

Insertion into forging dies

Fig.4E
Forging
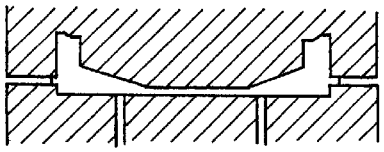
Fig.4F
Die opening, Removal of forged raw material
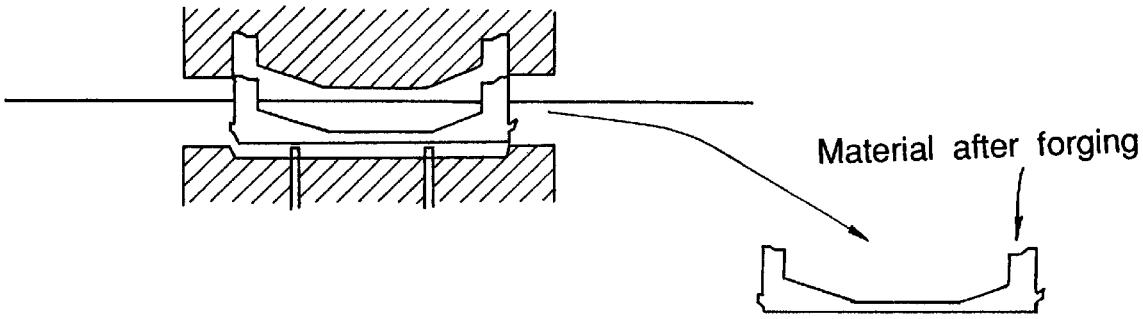
Fig.4G Test piece

METHOD OF PRODUCING LIGHT METAL ALLOY MATERIAL FOR PLASTIC WORKING AND PLASTIC-WORKED PRODUCT

BACKGROUND OF THE INVENTION

The present invention relates to a method of producing a material for plastic working made of a light metal alloy, particularly a magnesium alloy containing aluminum as an alloy component, and a method of producing a plastic-worked product by using the same.

PRIOR ART OF THE INVENTION

Light metal alloys containing aluminum or magnesium as a matrix, particularly magnesium alloys containing aluminum as an alloy component, have attracted special interest recently as materials, which are light-weight and capable of securing a predetermined mechanical strength by means of a plastic working such as forging. However, since these light metal alloys show good thermal shrinkage, the fluidity is lowered unless the casting temperature is raised in the gravity casting. Consequently, a perfect (fewer cavities) casting is not obtained. However, if the casting temperature is high, the cooling rate becomes smaller, resulting in coarse material structure, poor moldability and small working ratio. Therefore, the working process must be repeated again to obtain a molded article having a required shape. On the other hand, a fine structure can be obtained by die casting. However, since a molten metal is injected into a die under pressure in a spray state, a lot of fine cavities are contained in the casting to cause gas defects and, therefore, good forged materials can not be obtained.

To improve the forgeability of the light metal alloy containing aluminum and magnesium as the matrix, a cast material having a fine structure must be obtained by a method other than die casting. Therefore, as a result of intensive studies of the present invention, it has been found that, when the light metal alloy is injection-molded while adjusting the solid phase proportion or solid phase grain size using a semi-melt injection molding method, a material having good moldability can be obtained and a desirable molded article can be obtained by single-forging from the injection-molded material.

SUMMARY OF THE INVENTION

Therefore, a first object of the present invention is to provide a semi-melt injection molding method of producing a material having excellent plastic workability.

A second object of the present invention is to provide a method of injection-molding a material having excellent plastic workability and producing a forged article by means of single-step forging.

According to a first aspect of the present invention, there is provided a method of producing a material for plastic working made of a light metal alloy, which comprises preparing a light metal alloy into a molten state at a temperature just above a melting point or a semi-molten state wherein a solid phase and a liquid phase coexist and the solid phase proportion is not more than 20%; and subjecting the molten or semi-molten light metal alloy to injection molding.

According to a second aspect of the present invention, there is provided a method of producing a plastic worked light metal alloy product, which comprises preparing a light metal alloy into a molten state at a temperature just above a melting point or a semi-molten state wherein a solid phase and a liquid phase coexist and the solid phase proportion is not more than 20%; and subjecting the molten or semi-molten light metal alloy to an injection molding and further to a plastic working.

According to the present invention, it has been found that good moldability, wherein a limiting upsetting rate is not less than 70%, is obtained by adjusting the solid phase proportion to not more than 20% (see FIG. 1). It has also been found that, in not only the semi-molten state but also completely molten state, when injection molding is performed at the temperature just above the melting point of the matrix, it is possible to obtain a material having excellent moldability compared with the case of die casting.

The reason why the solid phase proportion is adjusted to not more than 20% is as follows.

That is, the lower the solid phase proportion becomes, the smaller the solid phase average grain size in the semi-molten state becomes. Furthermore, the smaller the solid phase average grain size becomes, the more the moldability of the injection molding material is improved. It has been found that the solid phase average grain size is preferably not more than 300 $\mu$m and the limiting upsetting rate is rapidly decreased when it exceeds 300 $\mu$m (see FIG. 2).

The reason why the above injection-molded article shows good moldability in case of injection molding at the solid phase proportion of not more than 20% is not clear, but is considered as follows. That is, the liquid phase portion is converted into a fine structure by injection molding in the semi-molten state and the moldability at the time of forging is good, whereas, the solid phase portion is liable to retain the form. Accordingly, when the proportion of the solid phase portion is too large or the grain size is too large, scatter in moldability occurs and the moldability is lowered as a whole.

Since the plastic workability, i.e. forgeability, of the material to be molded according to the present invention is improved, forging can be performed at the temperature of not more than 400° C. Consequently, the strength is improved. Since a net-shaped product can be produced by only single forging, in addition to injection molding, a plurality of forging dies and machining are not required, resulting in advantage such as excellent economical efficiency.

The method of the present invention is preferably applied to those containing magnesium as the matrix and 4 to 9% by weight of aluminum as the alloy component, as the light metal alloy. When the amount is smaller than 4% by weight, an enhancement of the mechanical strength is not expected. On the other hand, when the amount is more than 9% by weight, the moldability (limiting upsetting rate) is drastically lowered (see FIG. 3).

The light metal alloy obtained in the present invention is preferably subjected to a T6 heat treatment (composed of a solution treatment and an artificial age hardening treatment) as the condition of the heat treatment. As a result, the residual strain at the time of forging is removed and a change in shape with a lapse of time of the product does not occur and, furthermore, excellent ductility is further imparted.

According to the present invention, there can be provided an injection molding material having excellent moldability by means of continuous casting. Since the injection molding material is a billet having a rough shape, a final product can be obtained by means of single-step forging and the number of forging steps can be reduced. A perfect structure with fewer cavities is obtained and, therefore, the yield can be improved.

BRIEF DESCRIPTION OF THE DRAWINGS

The above and other objects and features of the present invention will become more apparent from the following description of a preferred embodiment thereof with reference to the accompanying drawings, throughout which like parts are designated by like reference numerals, and wherein:

FIG. 4E is a schematic illustration of the forging of the injection-molded material;

FIG. 4F is a schematic illustration of the removal of the forged article from the forging die;

FIG. 4G is an illustration of a forged article made in accordance with the present invention;

DETAIL DESCRIPTION OF THE PREFERRED EMBODIMENTS

Figure 1:
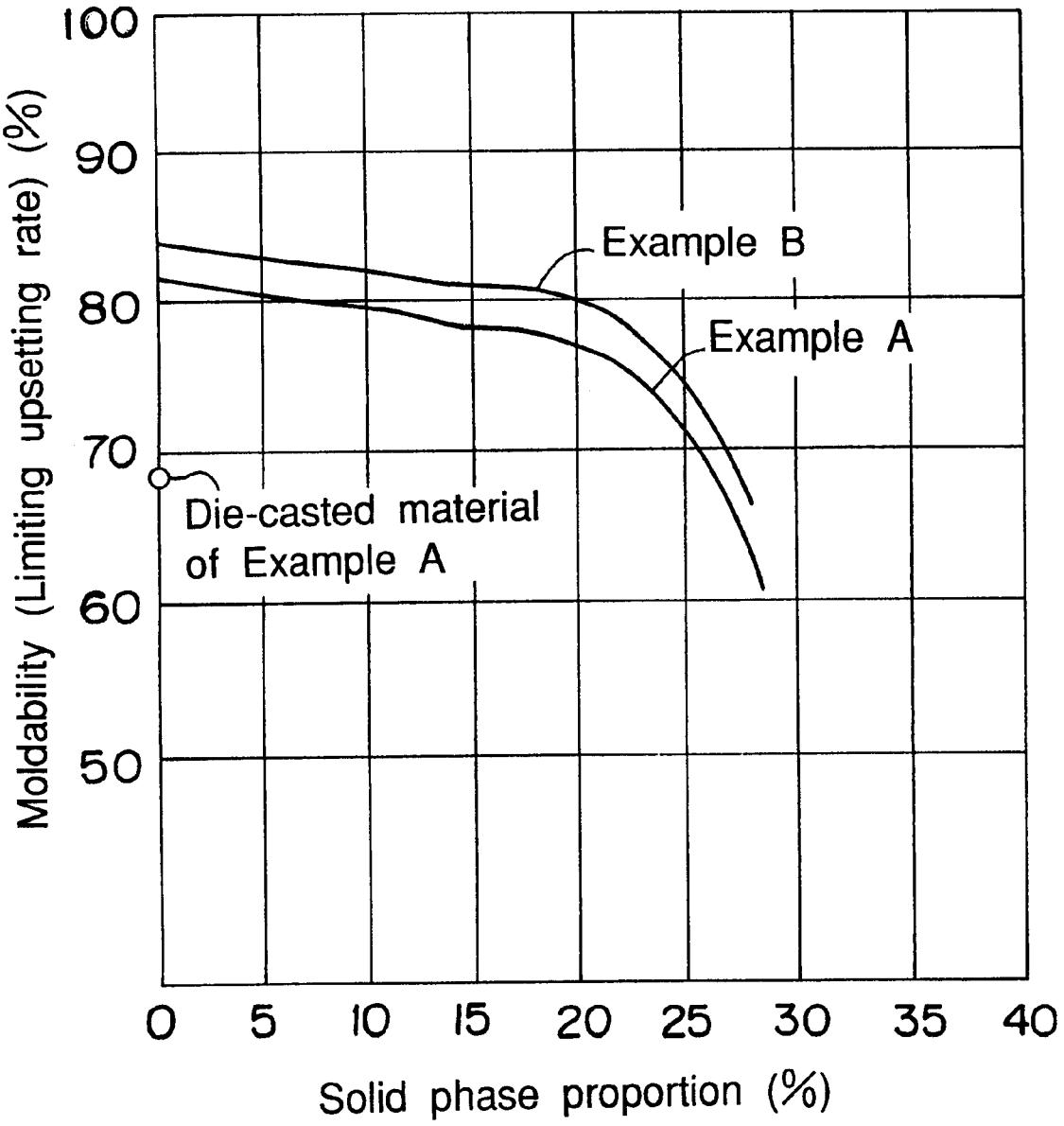
FIG. 1 is a graph showing a relation between the solid phase proportion and the moldability in injection molding of a magnesium alloy.
Figure 2:
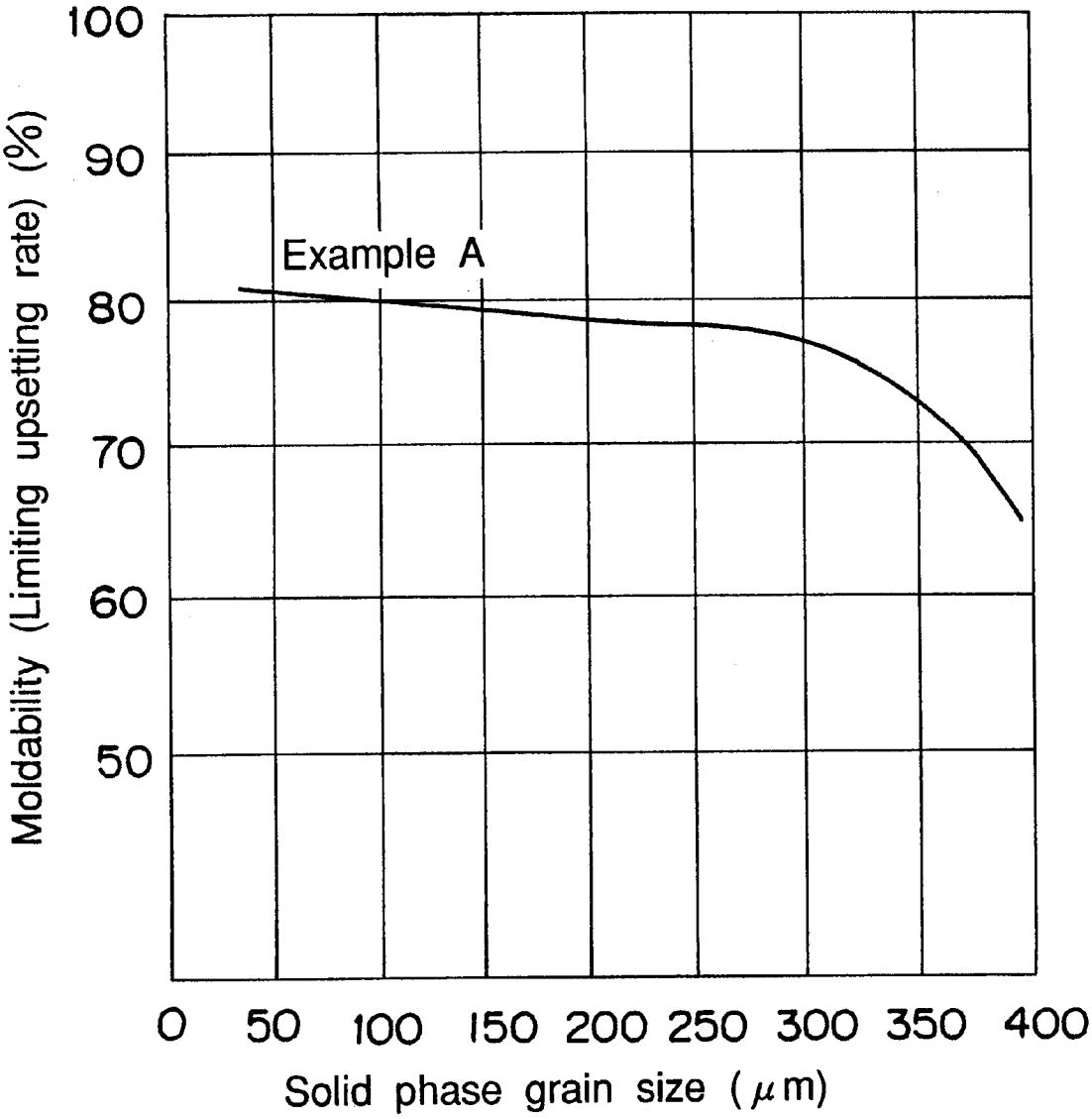
FIG. 2 is a graph showing a relation between the solid phase grain size and the moldability in semi-melt injection molding of a magnesium alloy.

The mode for carrying out the invention will be described in detail with reference to the accompanying drawings.

Magnesium alloys A, B having the following composition were injection-molded by using a semi-melt injection molder (Model: JLM-450E, manufactured by Nippon Seiko-Sho Co.) shown in FIGS. 4A–4G under the following conditions. In the figure, 1 denotes a cylinder, which is provided with a screw 2 therein, a high-speed injection mechanism 3 at the rear end and a die 4 at the front end, respectively. Heater 5 are arranged around the cylinder 1 in a predetermined distance, thereby to heat and melt a material to be charged through a hopper 6 provided at the inlet of the cylinder 1 in order.

First, raw chips obtained by cutting an ingot into pieces having a longitudinal axis of about 5 mm are charged into a hopper. The chips are fed into the cylinder every one shot by using a feeder, and are sent forward in a measuring step where the screw moves backward with rotating. The cylinder is divided into eight zones and temperature-controlled, and the chips are gradually heated during the conveyance to reach the semi-molten state in the forward portion. At a nozzle portion as a tip, the temperature is lowered to form a solidified plug, thereby preventing a molten metal from discharging. Ar gas is passed through the cylinder and hopper to prevent oxidation. The screw moves forward at high speed to fill the die with the molten metal sent forward at high speed, and the molten metal was rapidly solidified to form a molded article, which is then removed.

An injection-molded rough material W1 is removed after die opening (FIG. 4B), inserted between an upper forging die and a lower forging die (FIGS. 4C–4D) and forged (FIG. 4E). A forged article W2 is removed after die opening (FIG. 4F). This forged article W2 (FIG. 4G) is finished and then subjected to a T6 treatment. In the present invention, a proper T6 treatment varies depending on the material composition, but is generally composed of a solution treatment (at 380° C., for 10–24 hours) and an age hardening treatment (at 170° C. for 4–16 hours).

TABLE 1

Composition of magnesium alloy (unit: % by weight)

| | Al | Zn | Mn | Fe | Si | Cu | Ni | Mg |
|---|---|---|---|---|---|---|---|---|
| Alloy A | 8.8 | 0.45 | 0.25 | 0.001 | 0.03 | 0.004 | 0.001 | Bal. |
| Alloy B | 7.2 | 0.48 | 0.25 | 0.001 | 0.03 | 0.004 | 0.001 | Bal. |

TABLE 2

Condition of injection molding

| | |
|---|---|
| Injection pressure | 80 Mpa |
| Injection speed | 2 m/sec |
| Die temperature | 180° C. |

Figure 6:
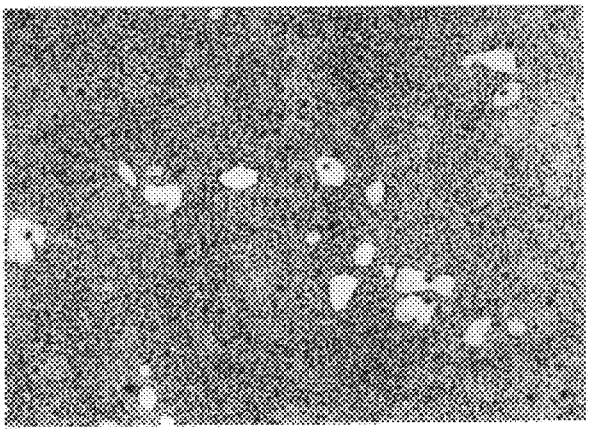
FIG. 6 is a micrograph showing a structure of the semi-molten injection molding material (solid phase proportion: 4%) injection-molded by the method of the present invention.
Figure 7:
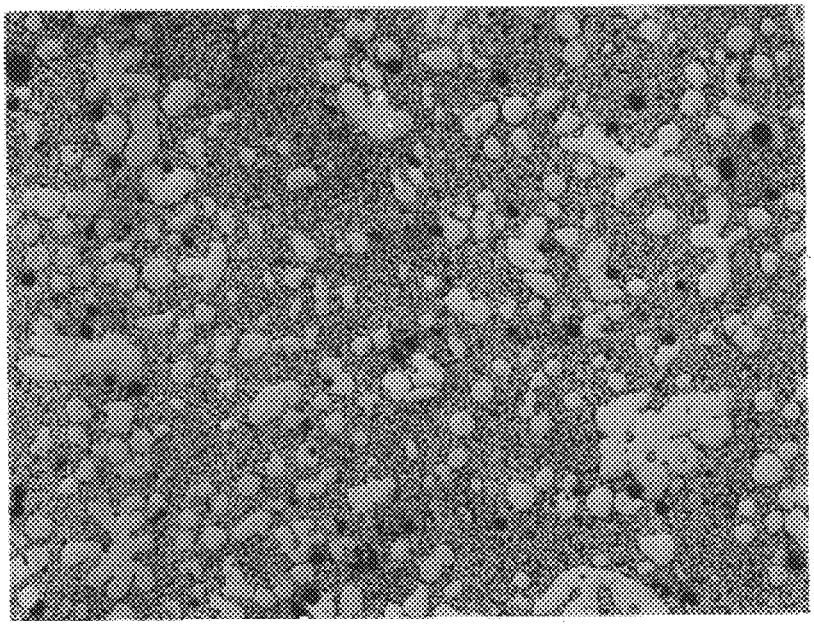
FIG. 7 is a micrograph showing a structure of the semi-molten injection molding material (solid phase proportion: 25%) injection-molded by the method of the present invention.

The magnesium alloy was ground into powders, which are introduced into the hopper. The solid phase proportion (solid phase/liquid phase) in the cylinder is adjusted by the heating temperature in the cylinder and the solid phase proportion before injection is adjusted within the range from 25 to 0%, and the injection molding is performed. When the solid phase proportion exceeds 20%, micro cavities are liable to increase (compare a micrograph of FIG. 6 (solid phase proportion: 4%) with that of FIG. 7 (solid phase proportion: 25%) for comparison, note: FIG. 6 and FIG. 7 relating to Example 6). Therefore, it is considered that the moldability is adversely affected. On the other hand, the alloy A is converted into the completely molten state (solid phase proportion: 0%) and die casting is performed.

Figure 5A:
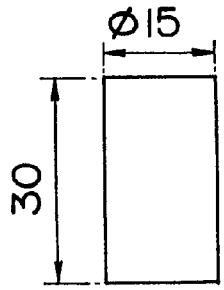
FIG. 5A is a schematic illustration of a test piece.
Figure 5B:
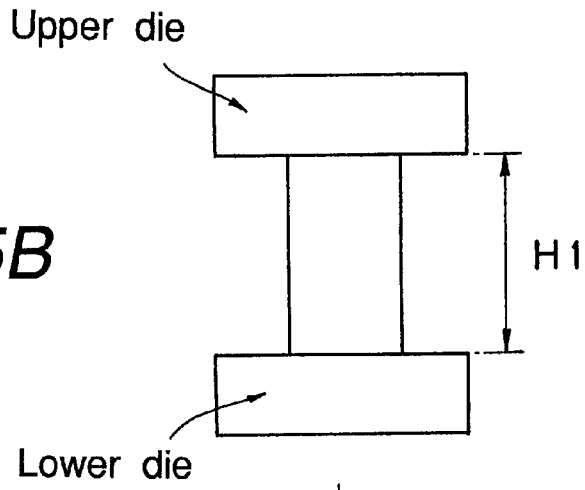
FIG. 5B is a schematic illustration of a test piece positioned in a die.
Figure 5C:
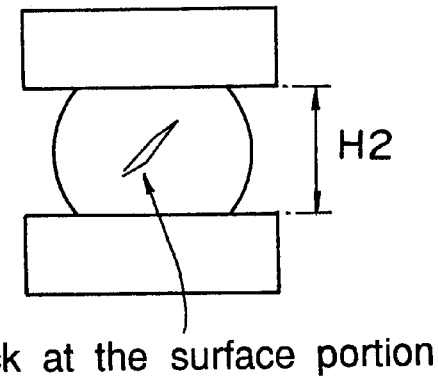
FIG. 5C is a schematic illustration of a test piece being deformed by the die.

As shown in FIGS. 5A–5C, test pieces having a diameter of 15 cm and a height of 30 cm were prepared from the injection-molded articles and die-casted articles in different solid phase proportions (FIG. 5A), inserted between a pressing upper and lower dies (FIG. 5B), heated to a test temperature of 350° C. and then upset while maintaining the test temperature until cracks occur on the surface. Assuming a distance between the upper and lower dies is H2, the limiting upsetting rate can be calculated by the following equation.

[Numeral 1]

$$\text{Limiting upsetting rate}=(H1-H2)/H1\times 100(\%) \quad \text{(I)}$$

The results are shown in FIG. 1. Regarding the material characteristics after injection molding, the portion corresponding to the liquid phase has a fine structure and shows good plastic workability. With the increase of the solid phase proportion, the moldability is gradually lowered. When the liquid phase proportion exceeds 20%, the lowering rate is rapidly increased. Comparing with the moldability of the die-casted material, the injection-molded material was superior in moldability even in case of the completely molten state (solid phase proportion: 0%). The reason is considered that the die-casted material contains a lot of micropores.

The relation between the solid phase grain size and the moldability with respect to the alloy A was studied. As a result, when the solid phase grain size exceeds 300 $\mu$m, deformation with the portion corresponding to the liquid phase scatters and deterioration of the moldability occurs rapidly. This solid phase grain size has a relation with the solid phase proportion, and the solid phase grain size is liable to increase with the increase of the solid phase proportion. The solid phase grain size is measured by using an image analyzer.

Figure 3:
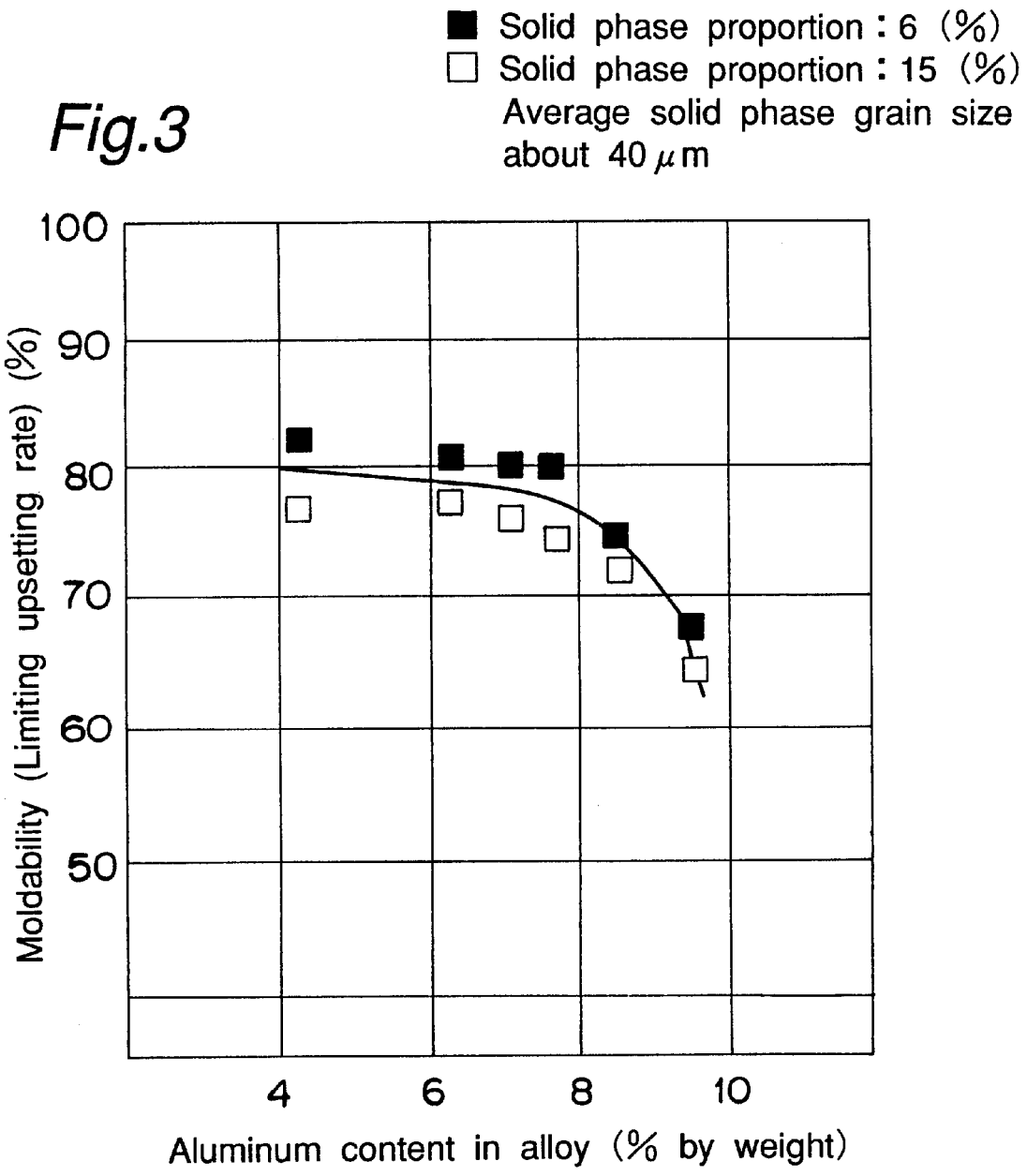
FIG. 3 is a graph showing a relation between the aluminum content and the moldability in semi-melt injection molding of a magnesium alloy.
Figure 4A:
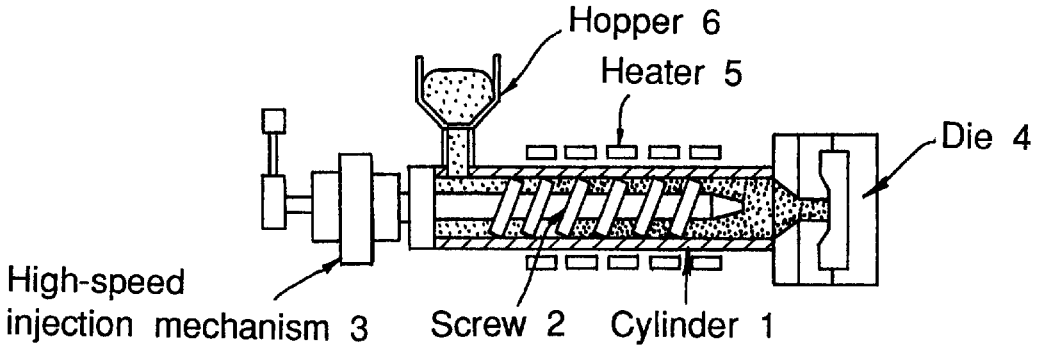
FIG. 4A is a schematic illustration of the injection molding process of the present invention in a closed die position.
Figure 4B:
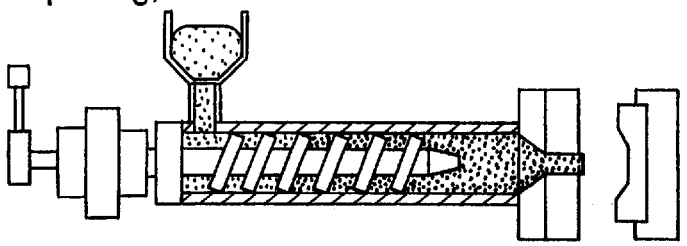
FIG. 4B is a schematic illustration of the injection molding process of the present invention in an open die position.
Figure 4C:
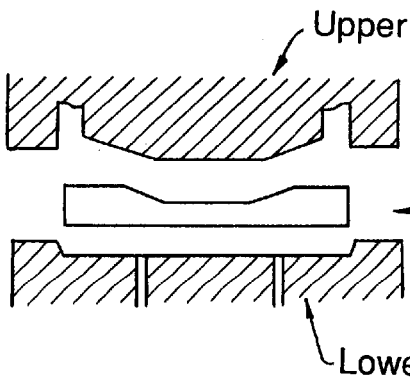
FIG. 4C is an illustration of the positioning of the injection molded rough material in the forging die.
Figure 4D:
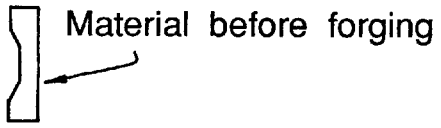
FIG. 4D is an illustration of the injection-molded rough material prior to forging.

Next, the relation between the content of aluminum in the injection molding material alloy and the moldability with respect to the magnesium alloys having the following compositions (Examples 1–6) was examined in case of the solid phase separation of 6% and 15%, respectively. As a result, the following fact has been found. That is, the average solid phase grain size was about 40 $\mu$m and the moldability is better in case of the solid phase proportion of 6%. When the content of aluminum exceeds 8.5%, the limiting upsetting rate is smaller than 70% and the moldability is deteriorated. The results are shown in FIG. 3.

TABLE 3

| | Chemical Composition | | | | | | | |
|---|---|---|---|---|---|---|---|---|
| | | | | | | | | % by weight |
| | Al | Zn | Mn | Si | Ni | Cu | Fe | Mg |
| Example 1 | 4.2 | 0.50 | 0.20 | 0.04 | 0.001 | 0.005 | 0.001 | Bal. |
| Example 2 | 6.2 | 0.48 | 0.25 | 0.03 | 0.001 | 0.004 | 0.001 | Bal. |
| Example 3 | 6.8 | 0.45 | 0.22 | 0.04 | 0.001 | 0.005 | 0.001 | Bal. |
| Example 4 | 7.3 | 0.47 | 0.25 | 0.03 | 0.001 | 0.004 | 0.001 | Bal. |
| Example 5 | 8.4 | 0.42 | 0.23 | 0.03 | 0.001 | 0.005 | 0.001 | Bal. |
| Example 6 | 9.2 | 0.48 | 0.23 | 0.03 | 0.001 | 0.005 | 0.001 | Bal. |

Figure 8:
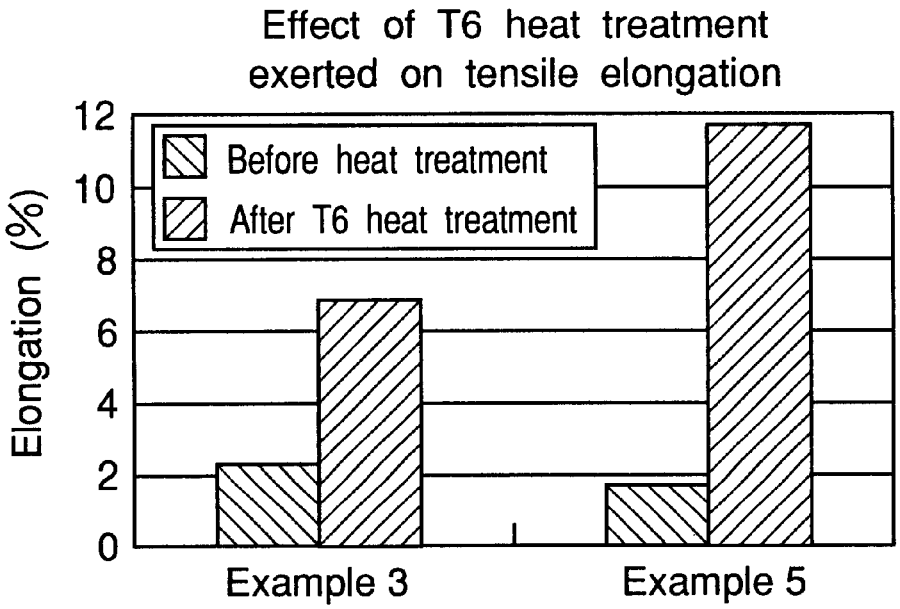
FIG. 8 is a graph showing a relation between the tensile elongation and the T6 heat treatment.
Figure 9:
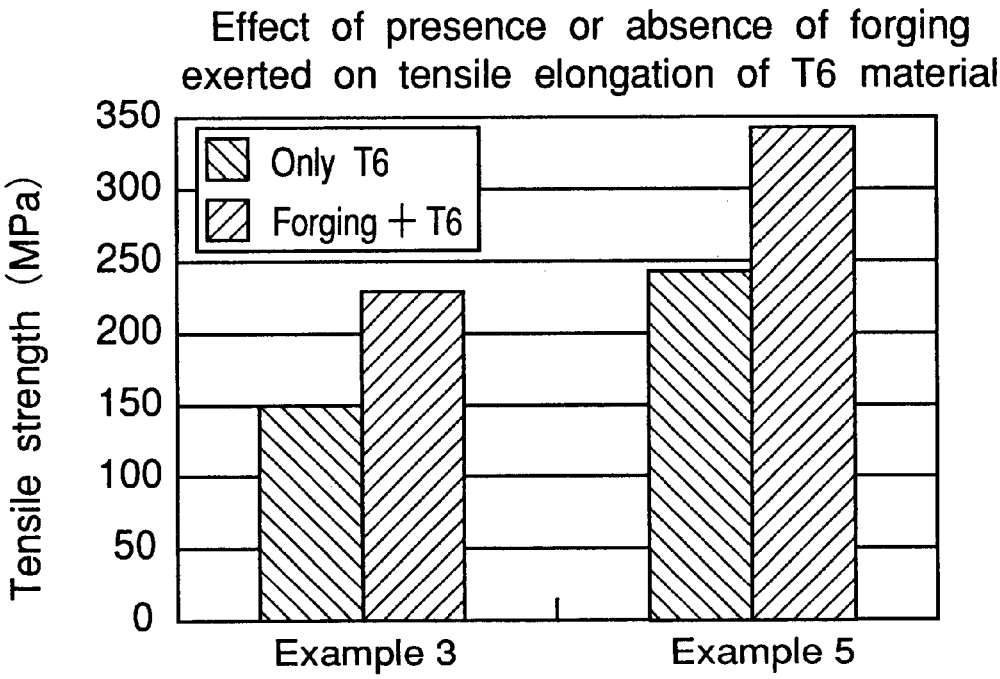
FIG. 9 is a graph showing a relation between the tensile strength of a T6 material and the presence or absence of forging.
Figure 10:
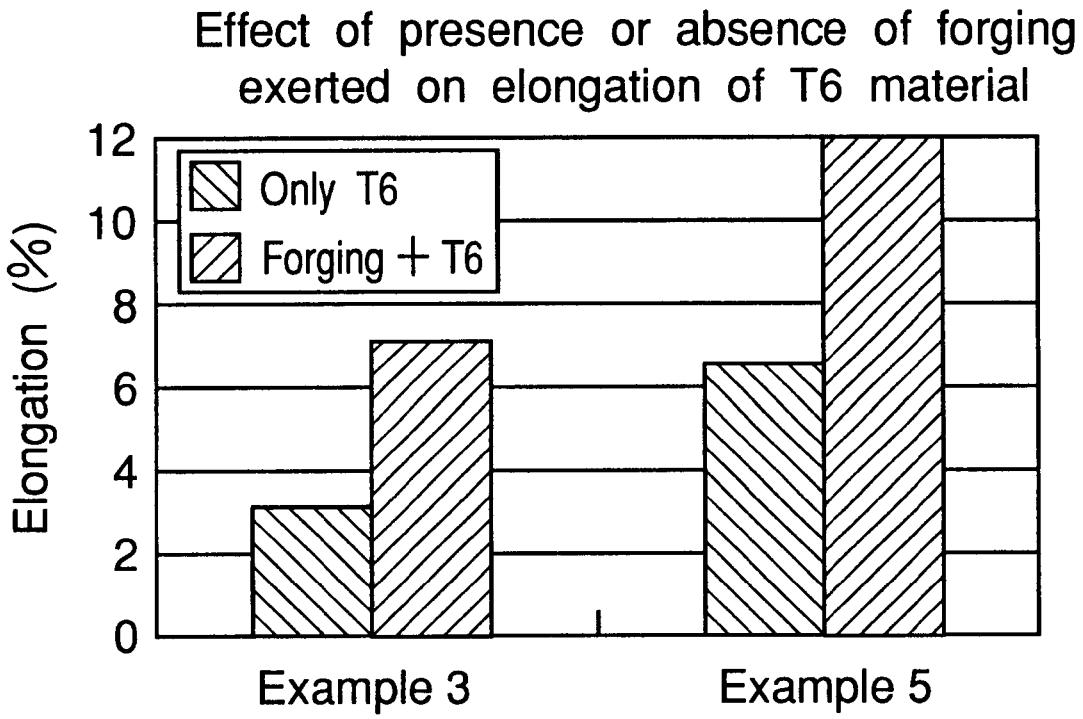
FIG. 10 is a graph showing a relation between the elongation of a T6 material and the presence or absence of forging.

Next, the results about the effect of the T6 treatment are shown in FIGS. 8 to 10.

The strength and ductility are remarkably improved by subjecting to the T6 treatment after forging compared with those obtained by forging the injection molded article as it is.

As described above, we confirmed various effects of the magnesium alloys. The relation between the solid phase proportion and the moldability is a phenomenon peculiar to the light metal alloy to be injection-molded by the semi-melt injection molding method and, therefore, the method of the present invention can be widely applied to light metal alloys containing magnesium and aluminum.

EFFECT OF THE INVENTION

As described above, according to the present invention, since the moldability of the injection molding material made of the light metal alloy can be improved, a rough molded article having good moldability can be obtained and a final forged article can be produced by means of single-step molding. Accordingly, the number of forging steps can be reduced compared with the case where a conventional continuous cast material is forged. Furthermore, since cavities are fewer than those of a die cast material, forging can be performed.

Furthermore, the strength and ductility are remarkably improved by subjecting to the T6 treatment after forging compared with those obtained by forging the injection molded article as it is.

What is claimed is:

1. A method of producing a light metal alloy material for plastic working, which comprises preparing a semi-solid light metal alloy containing a magnesium matrix and 4 to 8.5% by weight of aluminum as an alloy component and subjecting said semi-solid light metal alloy to an injection molding, wherein said semi-solid light metal alloy is made of a solid phase and a liquid phase with a solid phase proportion of not more than 20% and the limiting upsetting rate of said light metal alloy is not less than 70%.

2. The method according to claim 1, wherein an average grain size of said solid phase in the semi-molten state is not more than 300 $\mu$m.

3. A method of producing a light metal alloy material for plastic working, which comprises preparing a semi-solid light metal alloy containing magnesium as a matrix and 4 to 8.5% by weight of aluminum as an alloy component and subjecting said semi-solid light metal alloy to an injection molding, wherein said semi-solid light metal alloy is made of a solid phase and a liquid phase with a solid phase proportion of not more than 20%, the limiting upsetting rate of said light metal alloy is not less than 70%, and an average grain size of said solid phase in the semi-solid state is not more than 300 $\mu$m.

4. A method of producing a light metal alloy product, which comprises preparing a semi-solid light metal alloy containing a magnesium matrix and 4 to 8.5% by weight of aluminum as an alloy component, subjecting said semi-solid light metal alloy to an injection molding, and subjecting the molded light metal alloy to a plastic working, wherein said semi-solid light metal alloy is made of a solid phase and a liquid phase with a solid phase proportion of not more than 20% and the limiting upsetting rate of said light metal alloy is not less than 70%.

5. The method according to claim 4, which further comprises subjecting the worked light metal alloy to a heat treatment.

6. The method according to claim 5, wherein said heat treatment is performed under the condition of a T6 treatment.

7. The method according to claim 4, wherein an average grain size of said solid phase in the semi-molten state is not more than 300 $\mu$m.

8. The method according to claim 4, wherein said plastic working is forging.

9. The method according to claim 8, wherein said forging temperature is not more than 400° C.

10. A method of producing a light metal alloy product, which comprises preparing a semi-solid light metal alloy containing magnesium as a matrix and 4 to 8.5% by weight of aluminum as an alloy component, subjecting said semi-solid light metal alloy to an injection molding and subjecting the molded light metal alloy to a forging, wherein said semi-solid light metal alloy is made of a solid phase and a liquid phase with a solid phase proportion of not more than 20%, the limiting upsetting rate of said light metal alloy is not less than 70%, and an average grain size of said solid phase in the semi-solid state is not more than 300 $\mu$m.

* * * * *